US007040458B2

(12) United States Patent
Forsythe et al.

(10) Patent No.: US 7,040,458 B2
(45) Date of Patent: May 9, 2006

(54) ELEVATOR DESTINATION PROTOCOL CONTROL WITH FLEXIBLE USER INTERFACE

(75) Inventors: Steven Edson Forsythe, Lebanon, OH (US); Koji Sakata, West Chester, OH (US); Joseph P. Rennekamp, Mason, OH (US); John F. Miller, Jr., Hamilton, OH (US)

(73) Assignee: Fujitec America, Inc., Lebanon, OH (US)

( * ) Notice: Subject to any disclaimer, the term of this patent is extended or adjusted under 35 U.S.C. 154(b) by 132 days.

(21) Appl. No.: 10/607,644

(22) Filed: Jun. 27, 2003

(65) Prior Publication Data

US 2004/0262093 A1 Dec. 30, 2004

(51) Int. Cl.
*B66B 1/34* (2006.01)
*B66B 3/00* (2006.01)

(52) U.S. Cl. ..... 187/396; 187/395; 187/389; 187/391

(58) Field of Classification Search ..... 187/391–398, 187/247, 380–389
See application file for complete search history.

(56) References Cited

U.S. PATENT DOCUMENTS

| | | | | |
|---|---|---|---|---|
| 4,149,614 | A * | 4/1979 | Mandel et al. | 187/397 |
| 4,852,696 | A * | 8/1989 | Fukuda et al. | 187/392 |
| 5,831,226 | A * | 11/1998 | Hattori et al. | 187/382 |
| 6,062,346 | A * | 5/2000 | Friedli et al. | 187/395 |
| 6,065,570 | A * | 5/2000 | Friedli et al. | 187/387 |
| 6,315,083 | B1 * | 11/2001 | Schuster et al. | 187/391 |
| 6,394,231 | B1 * | 5/2002 | Schuster et al. | 187/382 |
| 6,502,668 | B1 * | 1/2003 | Chida et al. | 187/395 |
| 6,508,334 | B1 * | 1/2003 | Matsuda et al. | 187/391 |
| 2001/0035314 | A1 * | 11/2001 | Yoshida et al. | 187/382 |
| 2003/0164267 | A1 * | 9/2003 | Hikita | 187/391 |
| 2005/0098391 | A1 * | 5/2005 | Rintala et al. | 187/396 |

FOREIGN PATENT DOCUMENTS

| | | | |
|---|---|---|---|
| GB | 2241090 | A * | 8/1991 |
| JP | 01242379 | A * | 9/1989 |
| JP | 02225272 | A * | 9/1990 |
| JP | 03147685 | A * | 6/1991 |
| JP | 04169484 | A * | 6/1992 |
| JP | 06144726 | A * | 5/1994 |
| JP | 06191753 | A * | 7/1994 |

* cited by examiner

*Primary Examiner*—Jonathan Salata
(74) *Attorney, Agent, or Firm*—Frost Brown Todd LLC

(57) ABSTRACT

An elevator system having multiple elevator cars efficiently assigns cars and communicates the car assignments to the potential passengers. A hallway intuitive user interface is readily adapted to installations having varying numbers of elevator cars with varying floor access by incorporating a graphical display that is rendered accordingly. Moreover, a combination of visual, textual and aural indications are given to the passenger that the destination entered is valid and assigned to a car. For those instances where a potential passenger fails to enter a destination correctly, the elevator system retains a traditional elevator control interface in the elevator car.

19 Claims, 6 Drawing Sheets

ELEVATOR DESTINATION PROTOCOL CONTROL WITH FLEXIBLE USER INTERFACE

FIELD OF THE INVENTION

The present invention relates, in general, to elevator systems having a plurality of elevator cars, and more particularly, to an elevator control system for receiving passenger calls and for displaying car assignments in response thereto.

BACKGROUND OF THE INVENTION

Elevator systems often include a number of elevator cars that are assigned to pick up passengers in a coordinated fashion, thereby increasing the number of people that may be served. Typically, a passenger makes a hall call by depressing an up or a down button at the elevator waiting area. The elevator system assigns an available elevator to stop at that floor.

Early designs suffered from having rudimentary car assignment protocols that did not adjust to peak usage times. For example, during a "peak up" period, such as at the beginning of the workday, many people wish to use the elevator system from the ground floor. There is the reverse situation during a "peak down" period. The elevator system was not responsive to the number of passengers waiting at any given floor nor to their desired destination. Consequently, passengers tended to crowd onto the first available car, which then had to stop at numerous floors. The next available car would then be less crowded, but may very well have to stop at some of the very same floors as the first car.

Recently, elevator systems have incorporated hall calls that invite passengers to select a desired destination before entering an elevator call. With this information, the elevator control system may make destination pre-assignments that better utilize the available elevator cars. For example, the number of passengers and stops may be more evenly divided between cars. Inefficiencies are avoided such as two cars taking passengers between the same two floors.

These known elevator destination protocols accepted a keypad input or a selected floor button input from the ground floor elevator waiting area. The elevator control system then assigned an elevator car based on proximity, passenger call wait time, availability and what other floors were already assigned to this and other cars. The passenger was then directed to the proper car, typically by a display by each respective elevator door listing the assigned destinations for that car.

While these elevator systems that incorporate the known elevator destination protocol have been an advance over the more rudimentary assignment approaches, often passengers find these elevator systems inconvenient. Given the paradigm shift in how to use an elevator, many people fail to see the need for each rider to make a hall call for the desired destination. Instead, seeing that others have already made a hall call, some passengers at the elevator waiting area do not input their desired destination, choosing instead to enter the first available car. Alternatively, the passenger may select the wrong destination at the hall call or enter the wrong car. These known elevator systems are not flexible enough for passengers that prefer to operate the elevator in the traditional manner.

These mistakes are made more prevalent by some destination protocols that only accept destination requests at the ground floor for peak up period optimization. Another reason for such mistakes is that such elevator systems tend to have simplistic displays of a list of car assignments, which a passenger may misunderstand as a hall call rather than a destination.

These known elevator destination protocols are often constrained by the physical accessibility to the various elevator cars from the waiting area. Having not all of the elevators serve the same set of floors introduces difficulty, such as when one elevator serves fewer floors than the rest. Without knowledge of the passenger's desired destination, this car with limited service may be inadvertently dispatched to pickup the passenger. To address this problem, often an extra set of hall call buttons are added for each set of elevator cars that serve the same subset of floors, relying upon the passengers to read signage directing them to the appropriate bank of elevators.

Even with knowledge of passenger desired destination, other problems exist with elevators servicing different subsets of floors or being physically spaced apart from other elevators. Specifically, the known destination car assignment approaches communicate the car assignment in a nonintuitive fashion. A passenger may thus miss the assigned car by overlooking the car assignment. For instance, the car assignment may be displayed by an elevator that is not within view of the passenger.

Consequently, a significant need exists for an elevator destination control that enhances passenger interaction, both by being flexible in accepting a desired destination and by communicating car assignments in a more intuitive manner.

BRIEF SUMMARY OF THE INVENTION

The invention overcomes the above-noted and other deficiencies of the prior art by providing an elevator destination protocol control that receives a desired destination as part of the hall call for an elevator car. The control alerts the user that the desired destination is correctly requested and assigned to a specific car. In particular, a destination confirmation event is generated on a graphical hall call device that intuitively communicates with the user. Thereby, the efficient transport of users by destination protocol is enhanced through a less confusing user interface.

In one aspect of the invention, a method and system are provided wherein a graphical call device displays elevator car accessibility on that floor along with assigned destinations for those accessible elevator cars. The graphical hall call device generates a destination confirmation event so that a user knows that his desired destination has been properly assigned. Thereby, the user avoids an undue wait or frustration in instances wherein an invalid destination has been input or a validly input destination has been assigned without the user understanding the assignment.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
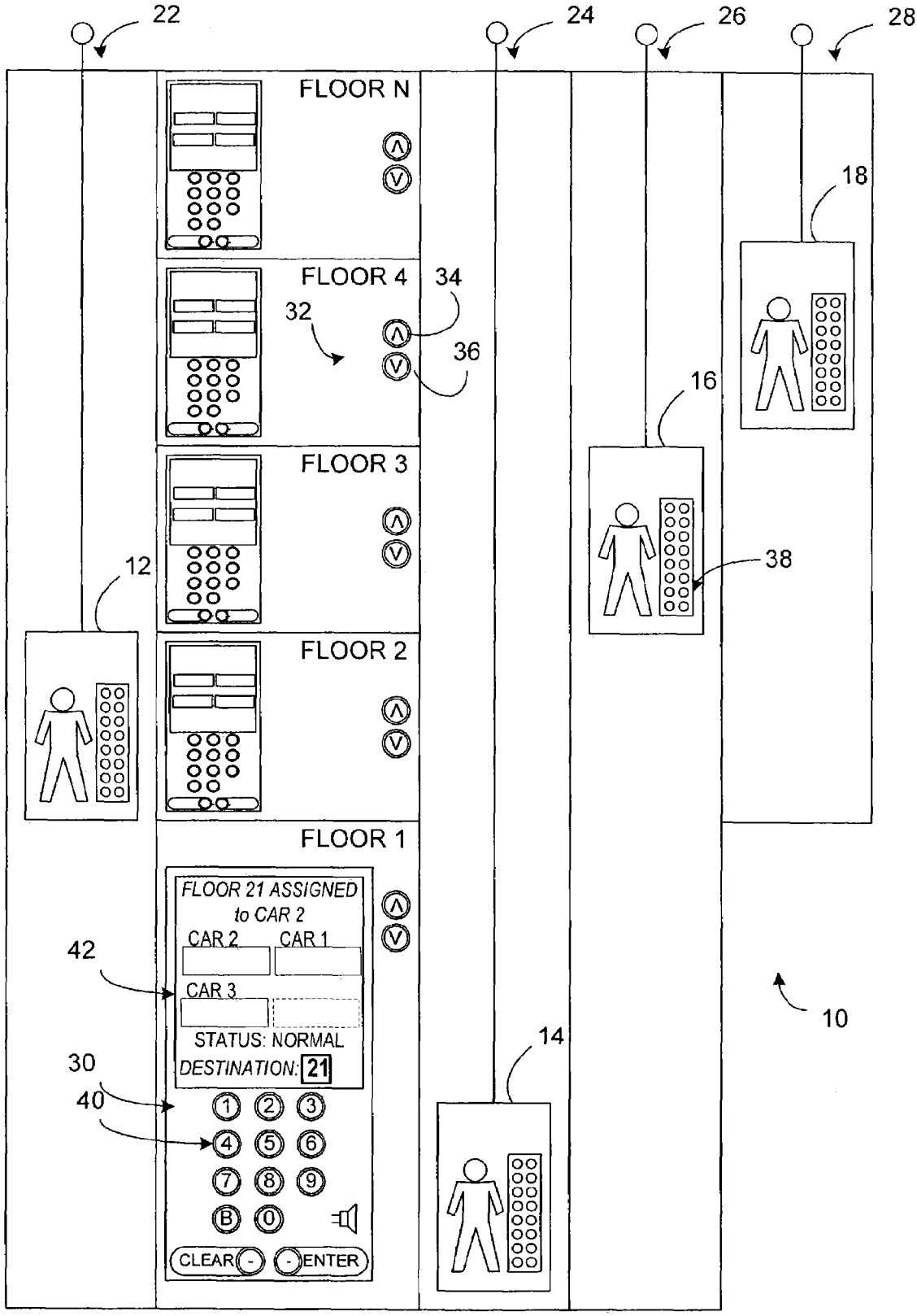
FIG. 1 is a diagram of an elevator system including an elevator predestination protocol control with hallway intuitive user interfaces and traditional in-car elevator controls.

Turning to the Drawings, wherein like numerals denote like components throughout the several views, FIG. 1 depicts an elevator system 10 having multiple elevator cars 12, 14, 16, 18 in respective elevator shafts 22, 24, 26, 28. The elevator system 10 advantageously enables predestination assignment of potential passengers in respective elevator waiting areas (Floor 1, 2, 3, 4, N), specifically by a graphical hallway call device 30. Thereby, the elevator system 10 may assign an elevator car 12–18 in a manner that reduces the wait time for the potential passengers and avoids a disproportionate number of intermediate stops for current passengers.

In addition to the advantages of predestination assignment, the elevator system 10 maintains a traditional elevator user interface 32 with up and down hall call buttons 34, 36, which may provide a backup interface for instances wherein the elevator destination protocol control is not desired or available. The traditional elevator user interface 32 also includes an elevator car panel 38 in each elevator car 12–18. Thus, passengers that inadvertently enter a car 12–18 without entering a desired destination beforehand may still select a floor, with the elevator system 10 being responsive thereto to reassign cars 12–18. Alternatively, the elevator car panel 38 may be used when a graphical hall call device 30 is not available on the floor or is otherwise disabled.

Each passenger receives additional visual and aural indications about the destination assignment of the cars by the graphical hallway call device 30 that reduces the likelihood, however, that the passenger would miss the assigned car. In particular, a keypad input 40 and a graphical display 42 on each graphical hallway call device 30 enable the elevator system 10 to be readily adapted to buildings with varying number of elevator cars having varying floor assignments. For instance, the elevator system 10 is responsive to one elevator car 18 having its elevator shaft 28 inaccessible on Floor 1 by omitting that car 18 from the graphical display 42 on Floor 1, while depicting this car 18 on the graphical displays 40 on other floors 2, 3, 4, N. Additional illustrations of the assistance to the passengers rendered by the graphical hallway call device 30 are described in more detail below, especially with regard to FIG. 5.

Figure 2:
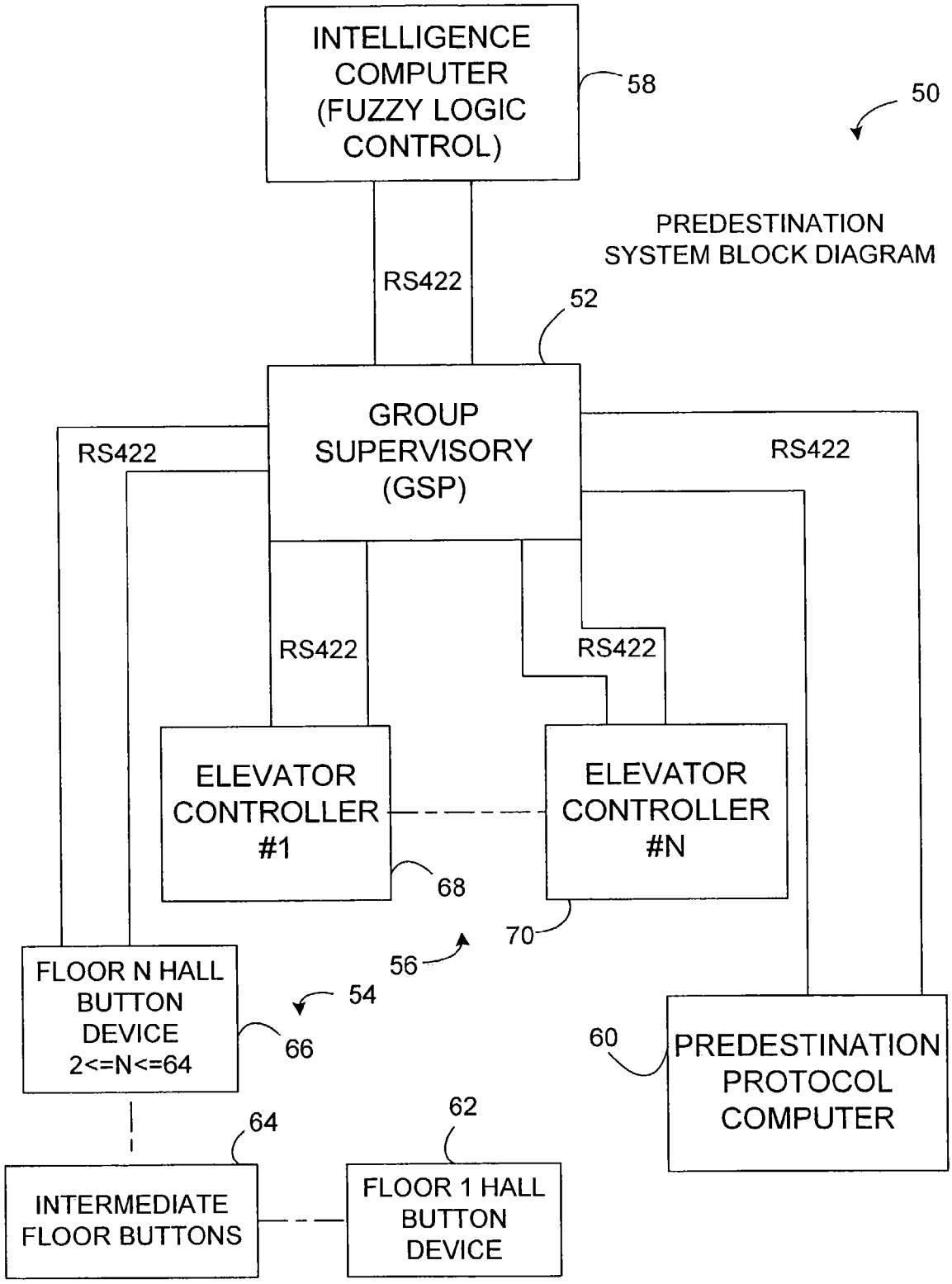
FIG. 2 is a block diagram of the elevator predestination protocol control of the elevator system of FIG. 1.

FIG. 2 depicts a predestination elevator control 50 that optimizes elevator car assignments for the elevator system 10. A group supervisory computer 52 receives traditional hall call user inputs 54 and/or predestination hall call inputs 56 and communicates these requests along with elevator car status (e.g., location, operability) via an RS-422 channel to an intelligence computer 58 that makes elevator car assignments in accordance with fuzzy logic control. The group supervisory computer 52 provides confirmation of the elevator car assignment back to the traditional hall call user inputs 54 and/or predestination hall call user inputs 56.

In the illustrative version, a predestination protocol computer 60 advantageously is located on a lobby floor level of the building. An administrator control (e.g., key, code input) may be used to set the predestination elevator control 50 into a traditional mode wherein the traditional hall call user inputs 54 are active. Thereby, a floor 1 hall button device 62, intermediate floor buttons 64, up to a highest floor N hall button 66 are monitored by the group supervisory computer 52.

The predestination protocol computer 60 may also have its administrator control set to a predestination mode wherein a graphical hall call device on the first floor ("elevator controller #1") 68 and any other graphical hall call devices ("elevator controller #N) 70 on other floors are active.

It should be appreciated that the group supervisory computer 52 in some applications may continue to respond to the traditional hall call user inputs 54 when in predestination mode. Alternatively, the group supervisory computer 52 may ignore traditional inputs. As a further alternative, the predestination protocol computer 60 may set the mode differently for each floor. For instance, predestination mode may be applicable to the first floor that has a graphical hall call device but be in traditional mode on other floors.

Figure 3:
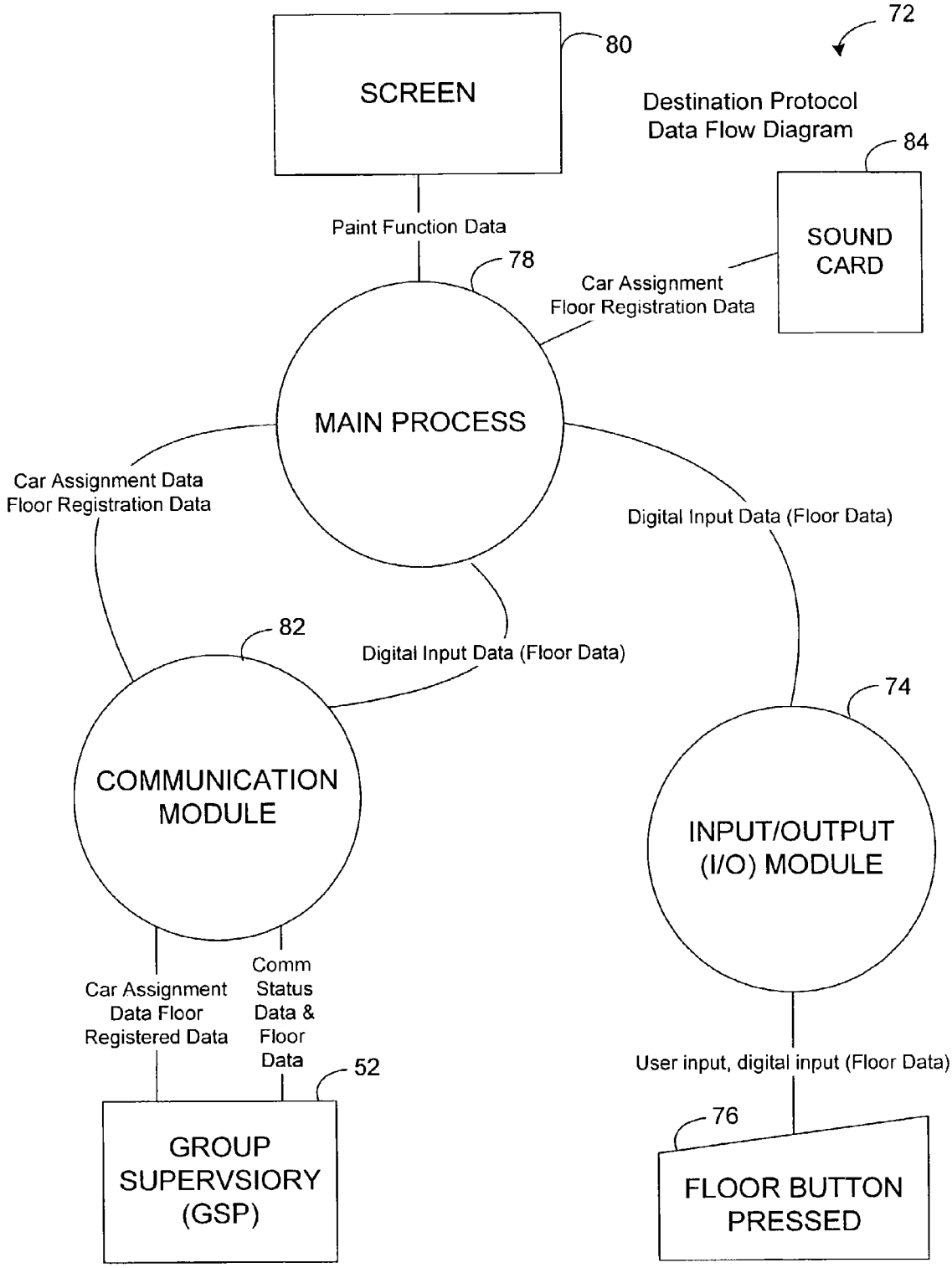
FIG. 3 is a data flow diagram of the elevator predestination protocol control of FIG. 2.

FIG. 3 depicts a software environment 72 for operating a predestination protocol computer 60 of FIG. 2. An input/output module 74 monitors for a manual input from a user ("floor button pushed") 76 and passes this digital input data along with the originating floor to a main process 78. The main process 78 provides confirmation that the destination requested is valid, communicating this validity via a paint function data to a graphical screen 80. The main process 78 conveys the digital input data (i.e., destination requested and originating floor) to a communication module 82, which in turn relays this information to the group supervisor computer 52. The communication module 82 in turn receives information from the group supervisory computer 52 to include communication status, car assignment data including assignment of any recently conveyed destination request, and location of the elevator cards, and conveys the same to the main process 78.

The main process 78 intuitively communicates the car assignment for the destination request by displaying it on the graphic screen 80 and/or by initiating audio cues from a sound card 84. For instance, the sound card 84 may give a verbal confirmation for the visually impaired that a specific destination has been assigned to a specific car. The sound card 84 could also give verbal directions to an assigned car when it opens on the originating floor, telling the prospective riders that floors assigned to that car.

Figure 4:
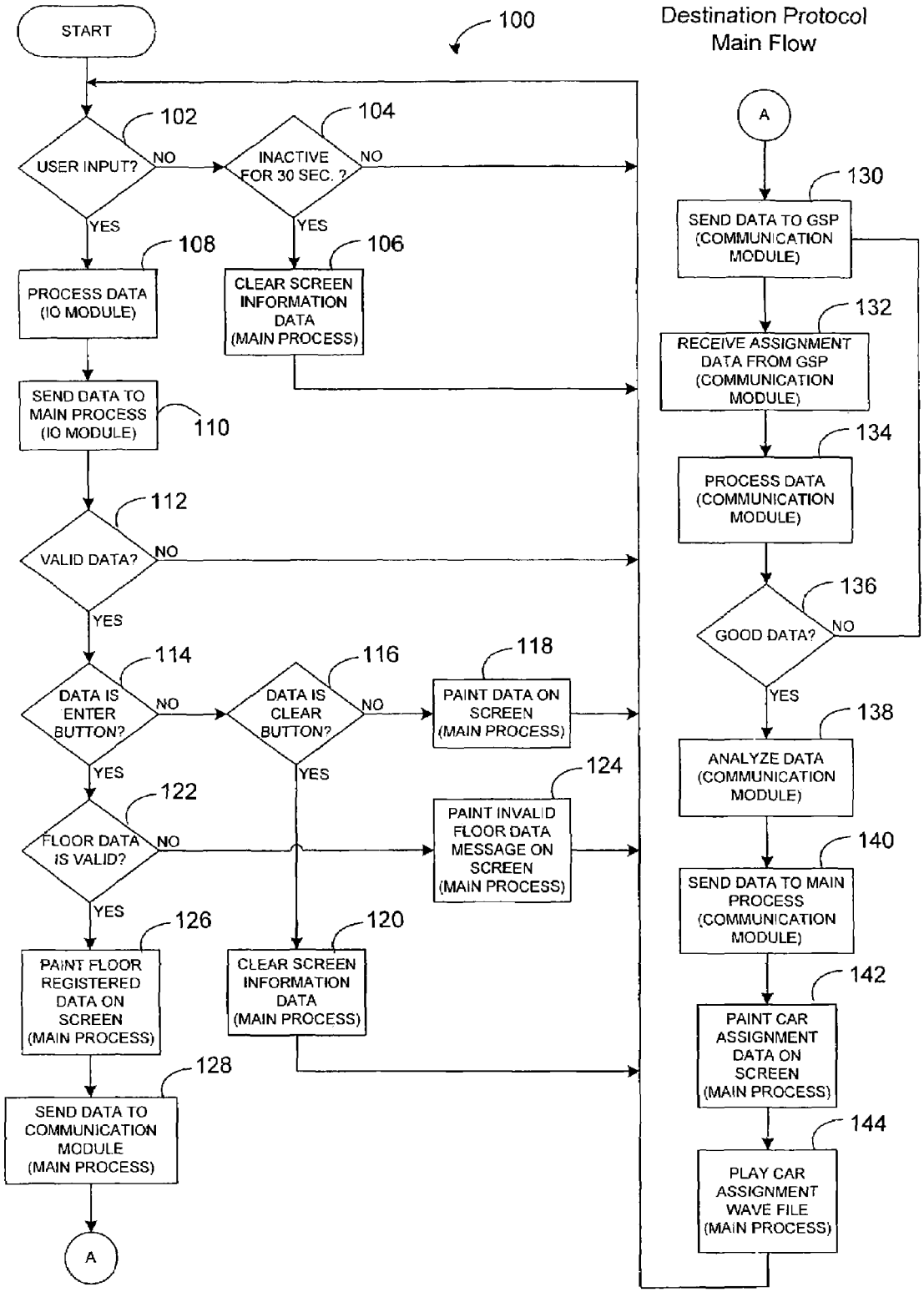
FIG. 4 is a flow diagram of the elevator predestination protocol control of FIG. 2.

FIG. 4 depicts an illustrative sequence of operation, or routine 100, performed by the predestination protocol computer 60 for intuitively interacting with users of an elevator system. Initially, a determination is made as to whether a user input has been made to a graphical hall call device (block 102). If not, then a further determination has been made whether no input has been made for a period of time (e.g., 30 seconds)(block 104). If more than the period of time has elapsed, then any data input to the graphical hall call device is cleared from the screen (block 106). This clearing prepares the screen for another user after having given sufficient time for the previous user to interact with the graphical hall call device. After either clearing the screen in block 106 or determining that time period has not expired in block 104, processing returns to block 102 to monitor for new user inputs.

If in block 102 a user input is detected, then the data is processed by the I/O module (block 108), such as by detecting a numeric sequence followed by an "enter" and by responding to any "clear" key entry. For instance, the processing may include filtering to prevent noise or other transient disturbances from being deemed a user input. The detected data is then sent to the main process from the I/O module (block 110).

The detected data is then determined to be valid data or not (block 112). For instance, if the detected data does not correspond to a key entry, then processing returns to block 102 and the input is ignored. If however, the detected data is a valid data entry from a key, then a further determination is made as to whether the data is an enter key or button input (block 114). If not, a further determination is made as to whether the data is a clear key or button input (block 116). If not, the data is a data entry that may be a portion of a floor destination, and thus the main process directs that the data be painted on the screen so that the user can see the initial entry of data (block 118), and processing returns to block 102 for the user to complete the data entry. If in block 116 a clear entry is detected, then the main process directs that the screen be cleared of information data (block 120) and processing returns to block 102.

Returning to block 114, if the data is determined to be an enter button, then a determination is made as to whether the full data entry painted on the screen designates a valid floor accessible from the point of origination of the floor data (block 122). If not, then the main process paints an invalid floor indication message on the screen (block 124) and processing returns to block 102.

If the requested destination floor is valid in block 122, then the main process paints the requested destination floor data as registered on the screen (block 126) so that the user knows that the request is valid and has been received by the predestination protocol control. The registered destination floor data is sent to the communication module from the main process (block 128). The communication module thereafter relays the destination floor data to the GSP for assignment (block 130).

In block 132, elevator car assignment data from the GSP is received by the communication module. Then the communication module processes the received assignment data into a digital format (block 134). Then a determination is made as to whether the received assignment data is good data (e.g., not noise corrupted) (block 136). The determination may advantageously include comparing the received assignment data with previously received car assignments and with the requested destination data to see if the latest assignments have been suitably updated. If not, processing returns to block 130 to resubmit the destination request.

If in block 136 the received data is deemed good, then the data is analyzed by the communication module for portions needed by the main process for interacting with the users (block 138). The analyzed portions are then communicated by the communication module to the main process (block 140), flagging in particular the car assigned to the most recent destination request. The main process in turn paints the car assignment data on the screen, designating in an intuitive fashion the requested destination by the user (block 142). The main process may further initiate a sound indication for the user to confirm the car assignment, which may include a verbal explanation of the car assignment (e.g., wave file) (block 144). Thereafter, processing returns to block 102 to await another user and to monitor changes in car assignments for display.

It should be appreciated that intermittently or continuously the current locations and current destination assignments for the elevator cars is communicated from the GSP to the predestination protocol control so that this information can be updated on the screen so that a user may view the status of elevator cars with or without making a destination input.

Figure 5:
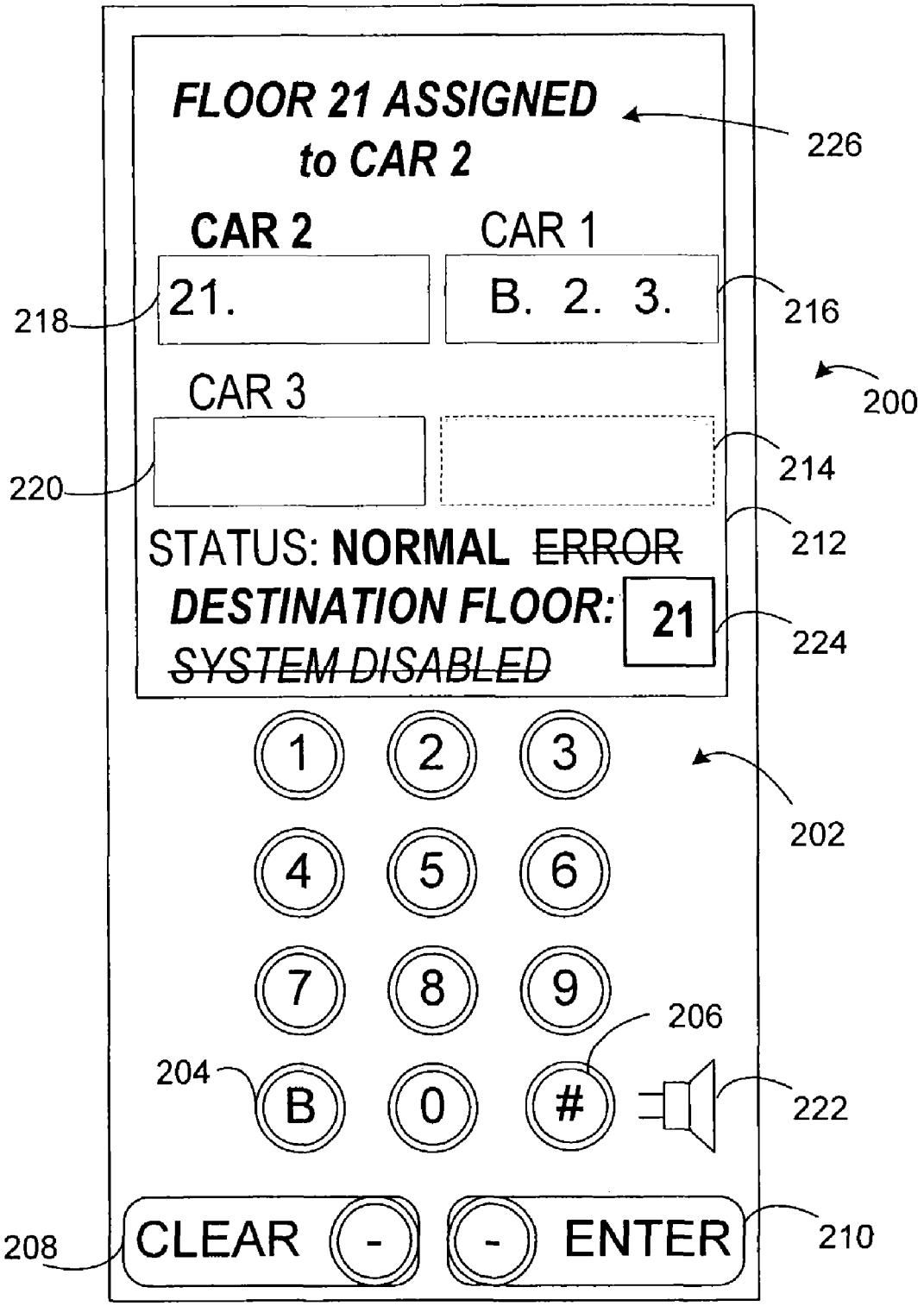
FIG. 5 is a diagram of the graphical hallway call device of the elevator system of FIG. 1.

FIG. 5 depicts a graphical hall call device 200 that is providing intuitive feedback to a user so that predestination protocol for efficient use is achieved by the elevator system. Although dedicated floor keys may be incorporated into the device 200, a keypad 202 advantageously allows for use in buildings having various ranges of floors. Specialized keys such as a "B" key 204 for basement designations may be included, as well as special function keys such as a "#" key 206 used by an administrator to access security and administrative configuration functions. A clear key 208 allows for inadvertent key entries to be cleared and an entry key 210 signals that a data entry has been completed by a user.

A graphics display 212 is advantageously configured for a detected or preset elevator system configuration. For example, the graphic display on this floor may be accessible by three of four elevator cars serviced by the elevator system. On this floor, the fourth car is not accessible and thus its display has been omitted at 214, whereas car assignments for Cars 1, 2, and 3 have been displayed respectively at 216, 218, 220.

When approaching the graphical hall call device 200, a user may note the status of the predestination protocol control, such as "Status: Normal" or "Status: Error" indicating whether or not the predestination protocol system is operable. Also, a "SYSTEM DISABLED" or "SYSTEM ENABLED" may be displayed indicating whether an administrator has turned on or off the predestination protocol control. The user may also monitor the current location and/or car assignments for each car in their respective assignment boxes 216–220. If not disabled, then the user inputs a desired floor with the keypad 202, such as a numeral "21" appearing beside "DESTINATION FLOOR".

If the floor entered is invalid, then a message to this effect may appear across the top of the graphic display 212 and/or a characteristic tone or indication may be played over a speaker 222. If, however, the requested destination floor is valid, then the request is relayed and the floor data boxed as at 224, or another suitable indication given. Once the requested destination has been assigned to an elevator car, then the destination floor is added to the respective car assignment box, such as at 218, a textual message explaining the assignment is displayed, such as at 226 (e.g., "Floor 21 assigned to Car 2").

Figure 6:
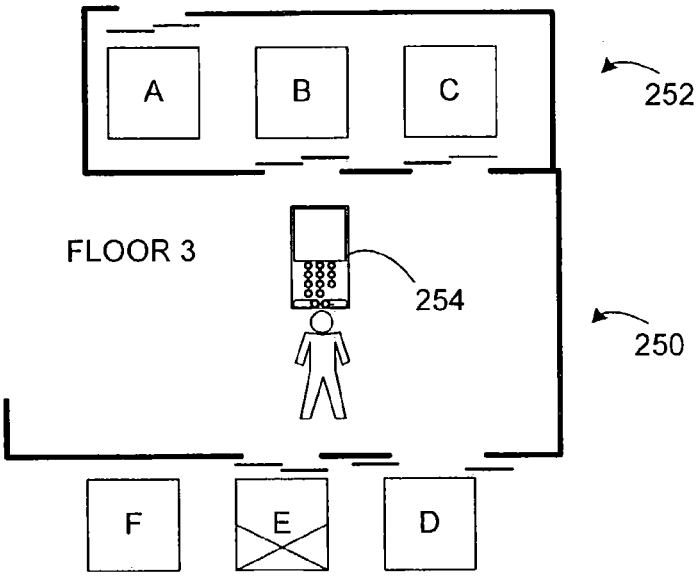
FIG. 6 is a plan view diagram of an elevator waiting area.

FIG. 6 depicts an illustrative elevator waiting area 250 of an elevator system 252 having six elevator cars A–F and how a user may be intuitively assisted by a graphical hall call device 254. In this scenario, car F is not accessible on floor 3 where the user is. Elevator car E is inoperative, although would typically service floor 3. Elevator cars A–D are operable and accessible on floor 3; however, elevator car A has an entry point not physically observable from the elevator waiting area 250.

Figure 7:
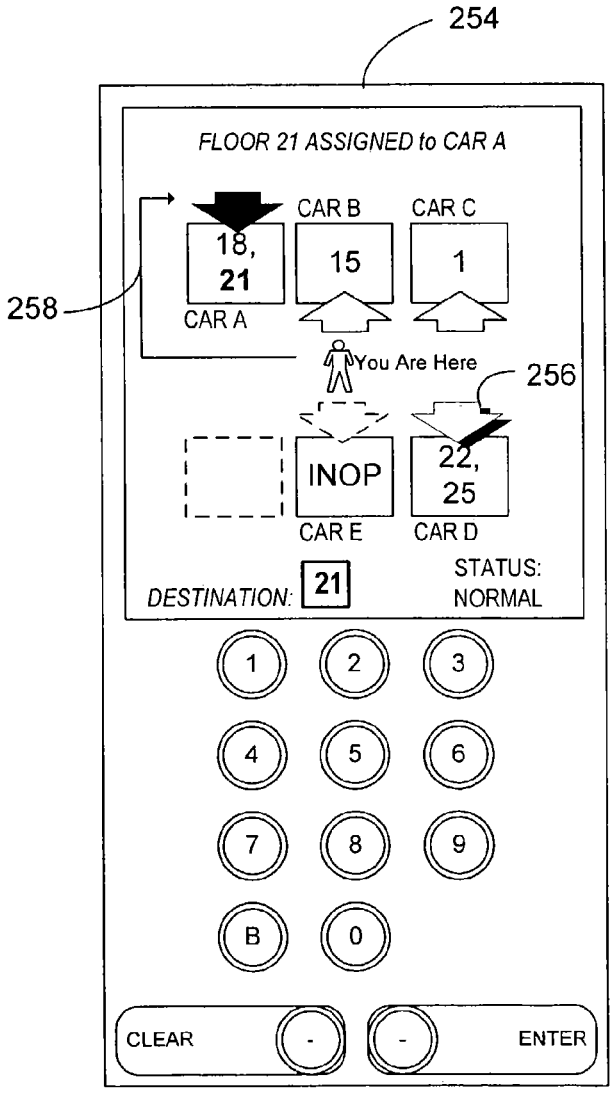
FIG. 7 is a graphical hallway call device displaying car assignments in relation to an oriented plan view diagram for accessible elevator cars.

FIG. 7 shows the illustrative graphical hall call device 254 in greater detail for this this scenario, wherein the car assignment information is more fully explained to the user, including spatial information to direct the user to the appropriate car. For instance, the user has input a destination of "21", which has been assigned and communicated to the user. The user or other users monitoring the screen for their own destinations may note what predestination assignments have been made for cars A–D, and may note that car E is inoperative. In addition, taking advantage of the graphical capabilities of the graphical hall call device 254, indications may be made as to where the entry points physically are for each car by arranging the car assignment information in the same plan view as the actual elevator cars. Moreover, the graphical hall call device may be configured to rotate the plan view the correct horizontal angle to conform to the installation of the device 254. The graphical hall call device 254 may further indicate which cars will be or are currently boarding on the floor, such as a visual and/or audio tone, like a flashing entry arrow 256.

The graphical hall call device 254 facilitates situations such as car A that is not visible by directing the user to its entry point, such as at arrows 258.

An advantage of having a graphical display and key pad data entry is that additional features may be readily accessible through a graphical hall call device. For instance, elevator monitoring system (EMS) functionality may be incorporated. Typically, an elevator control system interfaces with an EMS so that an administrator may override certain automated settings. Having access to such features may enhance the convenience of the EMS.

Examples of what may become accessible once an administrator accesses EMS features include a command menu:

Floor Lockout Command—Use this Command to prevent Car Calls and Hall Calls from being registered at selected floors;

Car Call Lockout Command—Use this Command to prevent the registration of Car Calls to selected floors;

Car Call Registration Command—Use this Command to register Car Calls in a particular elevator;

Parking Operation Command—Use this Command to place the car into Parking Operation. This will cause the elevator to run to the designated parking floor where it will be removed from Normal Operation;

Independent Operation Command—Use this Command to place the car into Independent Operation. During Independent Operation the elevator will respond to Car Calls only, and will not respond to Hall Calls. The elevator doors will open automatically when responding to a call, but need to be closed by applying constant pressure to the door close button or the car call registration button;

VIP Operation Command—Use this Command to place the car into VIP Operation. During VIP Operation the elevator is sent to the VIP Floor where it will wait for the registration of a Car Call. The elevator will wait, for up to three minutes, with the doors open. The elevator will not respond to Hall Calls during this time. This Command can not be scheduled;

Freight Operation—Use this Command to Start or Stop Freight Operation. Activating Freight Operation removes the elevator from group operation. The elevator then responds to Hall Calls registered from a separate group of Hall Buttons; and Security (Card Reader) Override—Use this Command to Start or Stop Security (Card Reader) Override Operation. Activating Security Override Operation overrides Card Reader Operation.

The graphical display may advantageously be augmented with additional information when in EMS functions:

Mode of Operation—Examples of modes of operation in order of priority: Inspection, Fireman, Emergency Power, Seismic, Medical Emergency, Parking, Independent, VIP, Freight, Fully Automatic;

Load Percentage—Displays the percentage load of the car with respect to the car's rated capacity;

Direction—up, down or none;

Position;

Door Status—open, midway, 1 inch from fully closed, closed;

Pending Car Calls;

Pending Hall Calls;

Floor Lockout Status; and

Hall Call Communication Status.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For example, it should be appreciated by those skilled in the art having the benefit of the present disclosure that applications of the present invention may omit controls in some elevator waiting areas or in some elevator cars 12–18.

As another example, more than one graphical hall call device may be placed on a floor, especially to accommodate more passengers and larger or multiple elevator waiting area. Each device may advantageously tailor its display, for instance orienting car assignment information to the physical layout relative to each device. In addition, a subset of the elevator cars may be displayed on each device, with text, automated voice, and/or graphical cues directing a passenger to the other device when entering a destination floor not served by that device.

As another example, although mechanical push buttons are illustrated herein, graphical hall call devices may incorporate touch screen controls instead. A further advantage of such graphically depicted inputs is that the system may include readily configurable buttons with desired symbols and text appropriate for the installation. The predestination request may be processed nonetheless even if displayed on the other device.

What is claimed is:

1. A method of interacting with a user of an elevator system having multiple elevator cars serving a plurality of floors with a graphical hall call device on one of the plurality of floors, the method comprising:

detecting and displaying on the graphical hall call device depictions of elevator cars accessible on the one floor;

displaying on the graphical hall call device respective assigned destinations for each depiction of an accessible elevator car;

receiving sequentially-entered, single numeric digit keypad entries designating a user desired destination; and generating a destination confirmation event on the graphical hall call device in response to receiving a user desired destination by monitoring elapsed time since an initial numeric single digit keypad entry, comparing the elapsed time to a threshold, resetting the destination confirmation event on the graphical hall call device in response to determining that a user entry command indicating completion of floor entry has not occurred prior to the elapsed time exceeding the threshold.

2. The method of claim 1, wherein generating a destination confirmation event comprises accentuating an accepted user desired destination.

3. The method of claim 1, wherein generating a destination confirmation event comprises textually describing an assignment status of the user desired destination.

4. The method of claim 1, wherein each elevator car includes a destination input panel inside of the elevator car, the method further comprising: in response to a desired destination input on the destination input panel for an elevator car not assigned apriori to the desired destination, assigning the desired destination to the elevator car; and adding the new assigned destination to the respective depiction of the selected elevator car on the graphical hall call device.

5. The method of claim 1, wherein a second floor of the plurality of floors contains a second graphical hall call device, the method further comprising:

detecting and displaying on the second hall call device elevator cars accessible on the second floor; and displaying on the graphical hall call device assigned destinations for each elevator car accessible on the second floor.

6. The method of claim 1, wherein detecting and displaying accessible elevator cars further comprises:

displaying a car assignment for each accessible elevator car in a spatial relationship corresponding to a plan view of the plurality of elevator cars.

7. The method of claim 6, further comprising:

accessing an elevator plan view;

accessing configuration data for the graphical hall call device;

spatially orienting the elevator plan view relative to the configuration data; and depicting direction arrows on the plan view corresponding to a suggested direction of travel from the graphical hall call device to an entry door of the depiction of the assigned elevator car.

8. The method of claim 1, wherein generating the destination confirmation event on the graphical hall call device in response to receiving the user desired destination further comprises:

generating an error message on the graphical hall call device in response to a determination that no one elevator car accessible on the floor of the graphical hall call device services the user desired destination.

9. The method of claim 1, wherein detecting and displaying on the graphical hall call device elevator cars accessible on the one floor further comprises:

displaying in a plan form view on the graphical hall call device depictions of elevator cars physically accessible on the floor serviced by the graphical hall call device; and annotating a selected elevator car depiction in response to a determination that the selected elevator car is inoperative.

10. An elevator hall call device positioned on a selected floor, interfaced to an elevator system having multiple elevator cars serving a plurality of floors, the elevator hall call device comprising:

a graphical display;

a numeric key pad comprised of at least 10 single numeric digit buttons; and a controller operatively configured to detect elevator cars of the elevator system accessible on the selected floor, to display a plurality of elevator car depictions on the graphical display corresponding to the accessible elevator cars, to receive sequentially-entered, single numeric digit keypad entries designating a user desired destination, and to generate a destination confirmation event on the graphical display in response to receiving a desired destination input from the user by monitoring elapsed time since an initial numeric single digit keypad entry, comparing the elapsed time to a threshold, resetting the destination confirmation event on the graphical hall call device in response to determining that a user entry command indicating completion of floor entry has not occurred prior to the elapsed time exceeding the threshold.

11. The elevator hall call device of claim 10, wherein the controller is further operatively configured to generate a destination confirmation event comprising accentuating an accepted destination input.

12. The elevator hall call device of claim 10, wherein the controller is further operatively configured to generate a destination confirmation event comprising textually describing an assignment status of the desired destination input.

13. The elevator hall call device of claim 10, wherein each elevator car includes a destination input panel inside of the elevator car, the controller further operatively configured to determine that a user desired destination on the destination input panel for an elevator car is not assigned apriori to the desired destination, to assign the desired destination to the elevator car, and to add the new assigned destination to the respective car display on the graphical hall call device.

14. The elevator hall call device of claim 10, wherein the controller is further operatively configured to display a car assignment for each accessible elevator car in a spatial relationship corresponding to a plan view of the plurality of elevator cars.

15. The elevator hall call device of claim 10, wherein the controller is further operatively configured to access an elevator plan view, to access configuration data for the graphical display, to spatially orient the elevator plan view relative to the configuration data on the graphical display, and to depict direction arrows on the elevator plan view on the graphical display corresponding to a suggested direction of travel from the graphical display to an entry door of depiction of the assigned elevator car.

16. The elevator hall call device of claim 10, wherein the controller is further operatively configured to generate the destination confirmation event on the graphical hall call device in response to receiving the desired destination input from the user by generating an error message on the graphical display in response to a determination that no one elevator car accessible on the floor of the graphical hall call device services the desired destination.

17. The elevator hall call device of claim 10, wherein the controller is further operatively configured to display in a plan form view on the graphical display depictions of elevator cars physically accessible on the floor serviced by the graphical hall call device, and to annotate a selected elevator car depiction in response to a determination that the selected elevator car is inoperative.

18. The elevator hall call device of claim 10, wherein the controller is further operatively configured to receive a destination floor input from an elevator control positioned inside of a selected elevator car, to add the destination to the destinations assigned to the elevator car in response to a determination that the elevator car was not assigned a priori to that floor, and to annotate the added destination to a depiction of the selected elevator car on the graphical hall call device.

19. An apparatus, comprising:

a plurality of elevator cars each respecting servicing at least a subset of a plurality of floors of a building;

circuitry operatively configured to assign destination floors for each elevator car of the plurality of elevator cars; and an elevator hall call device positioned on a selected floor of the plurality of floors, interfaced to circuitry, the elevator hall call device comprising:

a graphical display, a numeric key pad comprised of at least 10 single numeric digit buttons, and a controller operatively configured to detect elevator cars of the elevator system accessible on the selected floor, to display a plurality of elevator car depictions on the graphical display corresponding to the accessible elevator cars, to receive sequentially-entered, single numeric digit keypad entries designating a user desired destination, and to generate a destination confirmation event on the graphical display in response to receiving a desired destination input from the user by monitoring elapsed time since an initial numeric single digit keypad entry, comparing the elapsed time to a threshold, resetting the destination confirmation event on the graphical hall call device in response to determining that a user entry command indicating completion of floor entry has not occurred prior to the elapsed time exceeding the threshold.

* * * * *